US007394203B2

(12) United States Patent
Ren et al.

(10) Patent No.: US 7,394,203 B2
(45) Date of Patent: Jul. 1, 2008

(54) METHOD AND SYSTEM FOR OPEN LAMP PROTECTION

(75) Inventors: Yuancheng Ren, San Jose, CA (US); Kaiwei Yao, San Jose, CA (US); Wei Chen, Campbell, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 0 days.

(21) Appl. No.: 11/303,329

(22) Filed: Dec. 15, 2005

(65) Prior Publication Data

US 2007/0138977 A1 Jun. 21, 2007

(51) Int. Cl.
*H01J 7/42* (2006.01)

(52) U.S. Cl. ..... 315/129; 315/130

(58) Field of Classification Search ..... 315/119–136, 315/291, 294, 297, 307, 308; 361/1, 91.1, 361/88; 323/276, 234
See application file for complete search history.

(56) References Cited

U.S. PATENT DOCUMENTS 5,144,117 A * 9/1992 Hasegawa et al. ..... 315/297
5,528,192 A 6/1996 Agiman et al.
5,615,093 A 3/1997 Nalbant
5,619,402 A 4/1997 Liu
5,757,173 A 5/1998 Agiman
5,892,336 A 4/1999 Lin et al.
5,923,129 A 7/1999 Henry
5,930,121 A 7/1999 Henry
6,104,146 A 8/2000 Chou et al.
6,198,234 B1 3/2001 Henry
6,198,245 B1 3/2001 Du et al.
6,259,615 B1 * 7/2001 Lin ..... 363/98
6,307,765 B1 10/2001 Choi
6,396,722 B2 5/2002 Lin
6,459,602 B1 10/2002 Lipcsei
6,469,922 B2 10/2002 Choi
6,501,234 B2 12/2002 Lin et al.
6,507,173 B1 1/2003 Spiridon et al.
6,515,881 B2 2/2003 Chou et al.
6,531,831 B2 3/2003 Chou et al.
6,559,606 B1 5/2003 Chou et al.
6,570,344 B2 5/2003 Lin
6,654,268 B2 11/2003 Choi
6,657,274 B2 12/2003 Comeau et al.
6,710,555 B1 * 3/2004 Terada et al. ..... 315/291
6,756,769 B2 6/2004 Bucur et al.
6,781,325 B2 8/2004 Lee et al.
6,809,938 B2 10/2004 Lin et al.
6,853,047 B1 2/2005 Comeau et al.
6,856,519 B2 2/2005 Lin et al.
6,864,669 B1 3/2005 Bucur
6,870,330 B2 3/2005 Choi ..... 315/307
6,873,322 B2 3/2005 Hartular
6,876,157 B2 4/2005 Henry
6,888,338 B1 5/2005 Popescu-Stanesti et al.

(Continued)

*Primary Examiner*—Douglas W. Owens
*Assistant Examiner*—Ephrem Alemu
(74) *Attorney, Agent, or Firm*—Perkins Coie LLP; Zhou Lu

(57) ABSTRACT

A detector circuit monitors the phase relationship between the lamp voltage and the excitation voltage, and if one or more conditions are met, triggers the open lamp protection process in a discharge lamp system. The detection circuit can be incorporated into a lamp voltage feedback circuit and implemented on the integrated circuit level with less cost and circuit complexity.

12 Claims, 4 Drawing Sheets

U.S. PATENT DOCUMENTS 6,897,698 B1 5/2005 Gheorghiu et al.
6,900,993 B2 5/2005 Lin et al.
6,906,497 B2 6/2005 Bucur et al.
6,936,975 B2 8/2005 Lin et al.
6,946,806 B1 9/2005 Choi
6,979,959 B2 12/2005 Henry
6,999,328 B2 2/2006 Lin
7,023,709 B2 4/2006 Lipcsei et al.
7,057,611 B2 6/2006 Lin et al.
7,061,183 B1 6/2006 Ball
7,075,245 B2 7/2006 Liu
7,095,183 B2 * 8/2006 Alexandrov ..... 315/224
7,095,392 B2 8/2006 Lin
7,109,665 B2 * 9/2006 Green ..... 315/224
7,112,929 B2 9/2006 Chiou
7,112,943 B2 9/2006 Bucur et al.
7,120,035 B2 10/2006 Lin et al.
7,126,289 B2 10/2006 Lin et al.
7,141,933 B2 11/2006 Ball
7,157,886 B2 1/2007 Agarwal et al.
7,161,309 B2 1/2007 Chiou et al.
7,173,382 B2 2/2007 Ball
7,183,724 B2 2/2007 Ball
7,183,727 B2 2/2007 Ferguson et al.
7,187,139 B2 3/2007 Jin
7,187,140 B2 3/2007 Ball
7,190,123 B2 3/2007 Lee et al.
7,200,017 B2 4/2007 Lin
2002/0180380 A1 12/2002 Lin
2004/0263089 A1 * 12/2004 Contenti et al. ..... 315/291
2005/0030776 A1 2/2005 Lin
2005/0093471 A1 5/2005 Jin
2005/0093482 A1 5/2005 Ball
2005/0093484 A1 5/2005 Ball
2005/0151716 A1 7/2005 Lin
2005/0174818 A1 8/2005 Lin et al.
2005/0225261 A1 10/2005 Jin
2006/0181227 A1 * 8/2006 Lu ..... 315/312
2006/0202635 A1 9/2006 Liu
2006/0232222 A1 10/2006 Liu et al.
2006/0279521 A1 12/2006 Lin
2007/0001627 A1 1/2007 Lin et al.
2007/0046217 A1 3/2007 Liu
2007/0047276 A1 3/2007 Lin et al.
2007/0085493 A1 4/2007 Kuo et al.

* cited by examiner

METHOD AND SYSTEM FOR OPEN LAMP PROTECTION

TECHNICAL FIELD

The present invention relates to the driving of fluorescent lamps, and more particularly, to methods and protection schemes for driving cold cathode fluorescent lamps (CCFL), external electrode fluorescent lamps (EEFL), and flat fluorescent lamps (FFL).

BACKGROUND OF INVENTION

Open lamp voltage schemes are often required in cold cathode fluorescent lamp (CCFL) inverter applications for safety and reliability reasons. In an open lamp condition, there might be a very large undesirable voltage occurring across the outputs if protections are not in place. This undesirable voltage may be several times higher than a nominal output and could be harmful to circuit components.

A conventional method to achieve open lamp voltage protection is to monitor the lamp current. The method is shown in FIG. 1 for in-phase applications and in FIG. 2 for out-of-phase applications. When lamp current becomes zero, the open lamp protection is triggered. In the open lamp protection circuits shown, an extra diode is needed for every lamp. Also, the open lamp detection circuit and the lamp voltage feedback circuit are independent. This results in undesired complexity of the overall circuit and associated high costs. A simpler open lamp protection method and circuit is needed.

BRIEF DESCRIPTION OF DRAWINGS

The following figures illustrate embodiments of the invention. These figures and embodiments provide examples of the invention and they are non-limiting and non-exhaustive.

DETAILED DESCRIPTION

Embodiments of a system and method that uses logic and discrete components to achieve open lamp voltage protection are described in detail herein. In the following description, some specific details, such as example circuits and example values for these circuit components, are included to provide a thorough understanding of embodiments of the invention. One skilled in relevant art will recognize, however, that the invention can be practiced without one or more specific details, or with other methods, components, materials, etc.

The following embodiments and aspects are illustrated in conjunction with systems, circuits, and methods that are meant to be exemplary and illustrative. In various embodiments, the above problem has been reduced or eliminated, while other embodiments are directed to other improvements.

The present invention relates to circuits and methods of open lamp voltage protection in discharge lamp applications. The circuits detect open lamp condition and trigger an open lamp protection process by monitoring the phase relationship between the lamp voltage and the excitation voltage that includes the voltage across the transformer.

Figure 1:
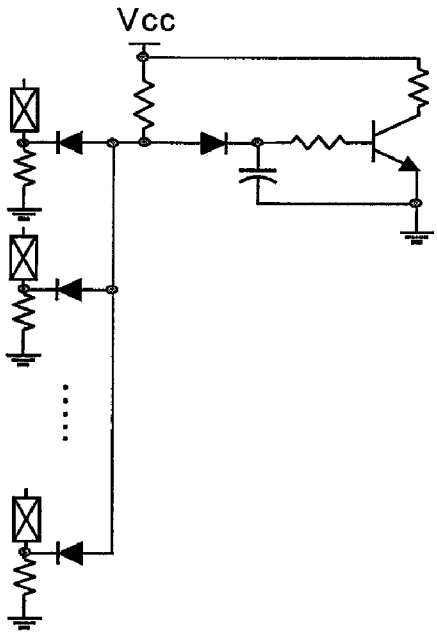
Figure 1 (Prior Art)
FIG. 1 An open lamp detection circuit for in-phase applications.
Figure 2:
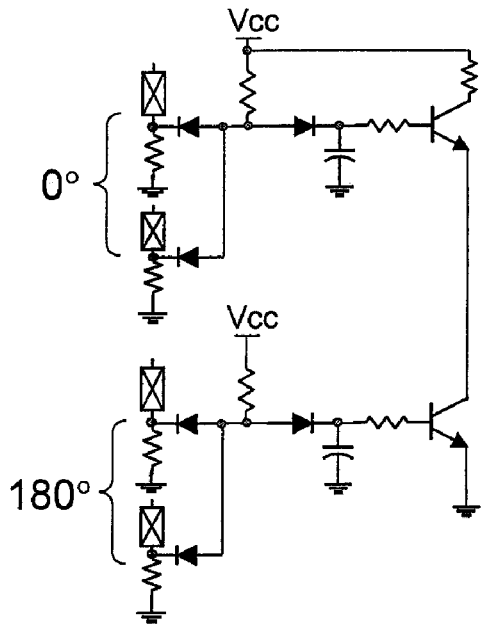
Figure 2 (Prior Art)
FIG. 2 An open lamp detection circuit for out-of-phase applications.
Figure 3:
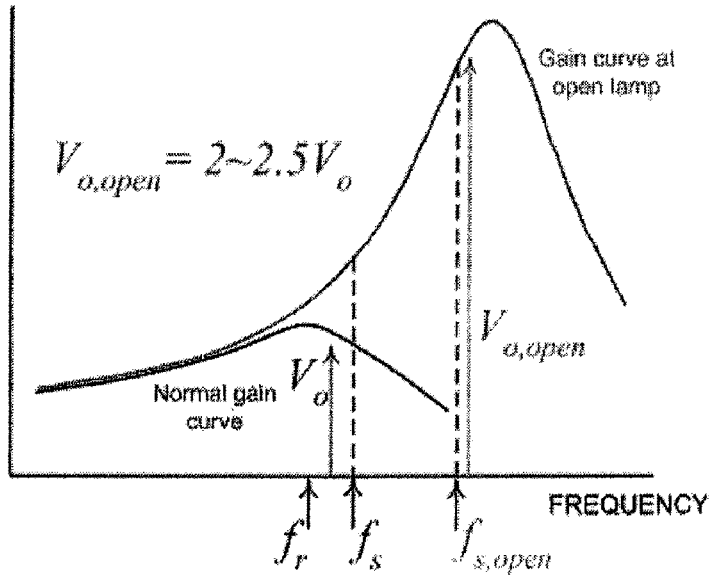
FIG. 3 Gain curves of a CCFL inverter.
Figure 4:
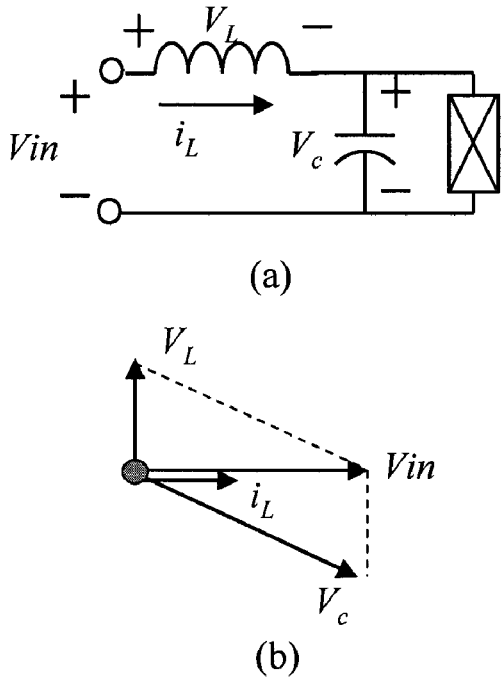
FIG. 4 The phase relationship between lamp voltage $V_c$ and excitation voltage $V_{in}$ under normal operation condition.

FIG. 3 shows gain curves of a typical CCFL inverter. Under normal operation, the inverter works with a switching frequency $f_s$, which is close to a resonant frequency $f_r$ in the inductive region of the bottom gain curve. Under an open lamp condition, the inverter works with $f_s$ in the capacitive region of the top gain curve. A CCFL lamp circuit under normal operation is plotted in FIG. 4(*a*). As indicated in the circuit, the input current $i_L$ and the excitation voltage $V_{in}$ are almost in phase. Further, the phase of the lamp voltage $V_c$ lags compared to the phase of $V_{in}$. The relationship between $i_L$, $V_{in}$, the inductor voltage $V_L$, and $V_c$ under normal operation is illustrated in the vector diagram of FIG. 4(*b*).

Figure 5:
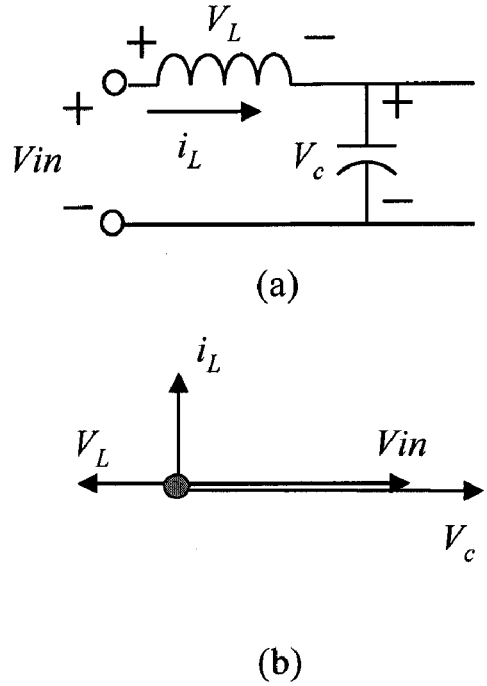
FIG. 5 The phase relationship between lamp voltage $V_c$ and excitation voltage $V_{in}$ under open lamp condition.

The CCFL lamp circuit under an open lamp condition is shown schematically in FIG. 5(*a*). As indicated in the circuit, $i_L$ and $V_{in}$ have almost 90 degrees phase difference. And $V_c$ and $V_{in}$ are almost in phase. The relationship between $i_L$, $V_{in}$, $V_L$, and $V_c$ under open lamp condition is illustrated in the vector diagram of FIG. 5(*b*). As seen, there is a significantly different phase relationship between $V_c$ and $V_{in}$ under normal operation and open lamp condition. In accordance to one embodiment of this invention, the phase difference between $V_c$ and $V_{in}$ is monitored and used for open lamp protection. The phase difference is used to trigger an open lamp protection process. When the open lamp protection process is triggered, the circuit increases the switching frequency $f_s$ hence the gain of lamp voltage. If the open lamp condition persists after a predetermined waiting time, the circuit shuts down immediately to prevent a potential over-voltage and damages to electronic components. Note that since the gate voltage of the power device has the same phase as that of $V_{in}$ in some applications, the phase difference between gate voltage and $V_c$ can also be used for open lamp protection. The power device is the one or more power transistors used to invert the DC power source into AC power for transmission into a transformer. Furthermore, the comparison between gate voltage and $V_c$ can be done on the integrated circuit level.

Figure 6:
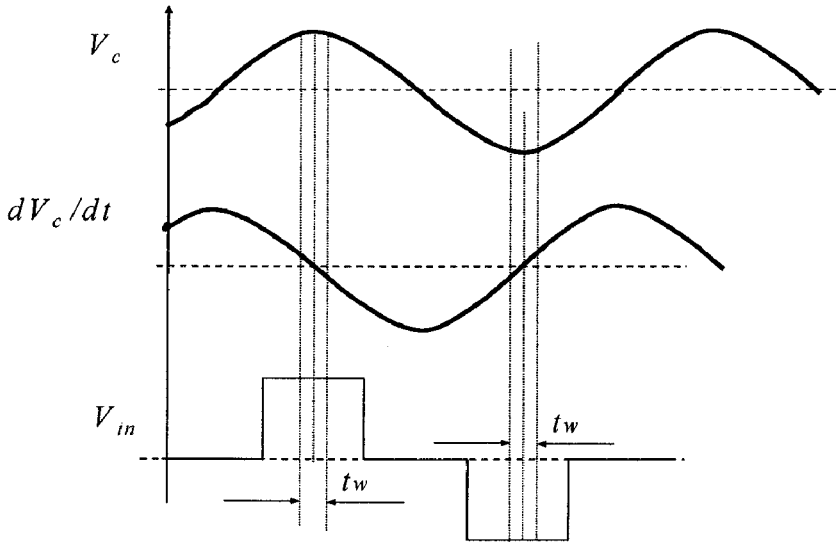
FIG. 6 An open lamp protection method using the phase relationship between lamp voltage and excitation voltage.
Figure 7:
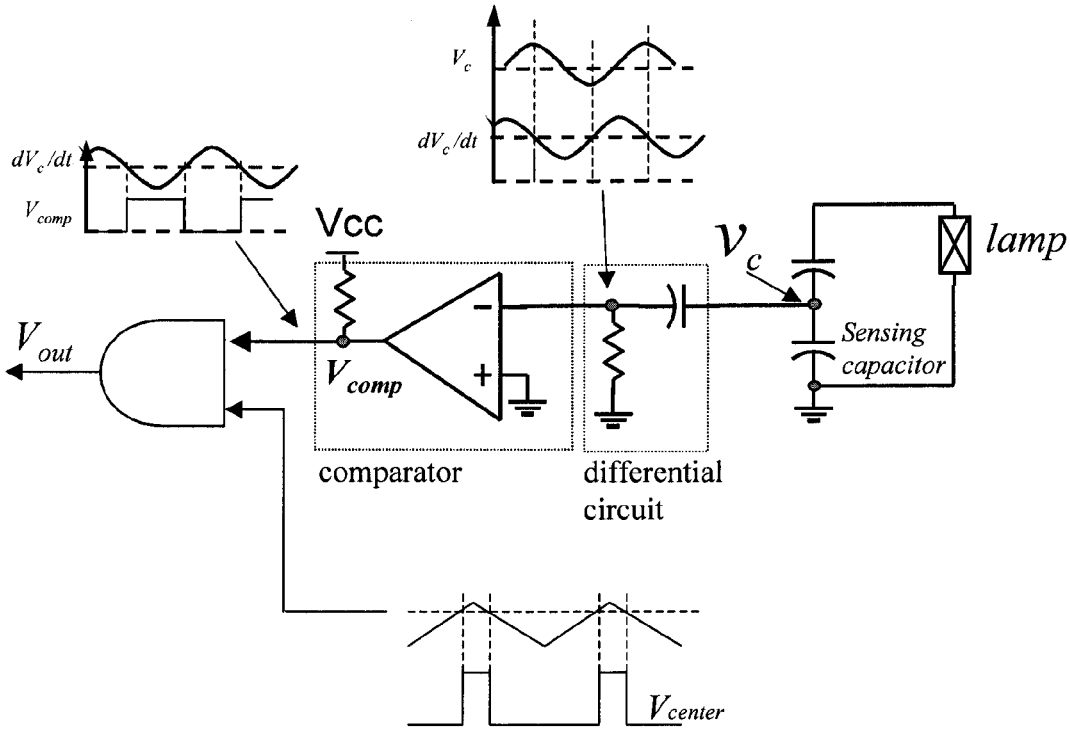
FIG. 7 An open lamp protection circuit in single lamp application.

One method for monitoring the phase difference between $V_c$ and $V_{in}$ is illustrated in FIG. 6. The slew rate of the lamp voltage $dV_c/dt$ is calculated and obtained. There is a detection window $t_W$ located in the middle of the $V_{in}$ pulse. If $dV_c/dt$ changes from positive to negative, or vice versa, within $t_W$, the open lamp protection process is triggered. If $dV_c/dt$ changes its sign, outside $t_W$, the open lamp protection process will not be triggered. An embodiment of this invention for a single lamp application is shown in FIG. 7. The sensed lamp voltage, $V_c$, is coupled to a differential circuit, which comprises a capacitor and a grounded resistor. The output of the differential circuit, $dV_c/dt$, is coupled to the negative terminal of a comparator whose positive terminal is coupled to ground or a threshold voltage $V_{th}$. The output of the comparator, $V_{comp}$, is coupled to an input terminal of an AND gate and a voltage source $V_{cc}$ through a resistor. The other input terminal of the AND gate is coupled to $V_{center}$, which is generated by a triangular waveform and a DC level. $V_{center}$ represents the middle portion of $V_{in}$. Since the triangular waveform is also used to generate the duty cycle of the discharge lamp inverter, the phase of the pulse is exactly the same as that of $V_{in}$. The DC level is used to adjust the width of $t_W$.

Figure 8:
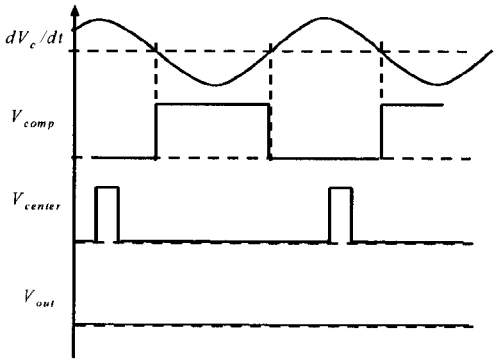
FIG. 8 Waveforms of $dV_c/dt$, $V_{comp}$, $V_{center}$, and $V_{out}$ in the circuit of FIG. 7 under normal operation condition.
Figure 9:
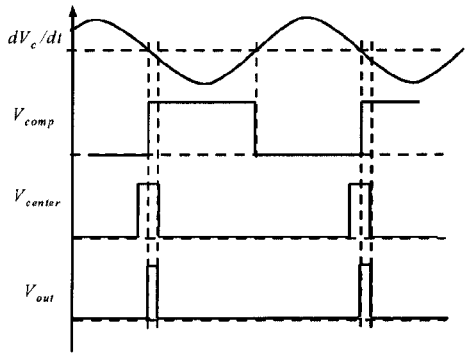
FIG. 9 Waveforms of $dV_c/dt$, $V_{comp}$, $V_{center}$, and $V_{out}$ in the circuit of FIG. 7 under open lamp condition.

FIG. 8 shows the waveforms of dVc/dt, Vcomp, Vcenter, and Vout in the circuit of FIG. 7 under normal operation condition. Under normal condition, $dV_c/dt$ changes its sign outside $t_W$. The comparator compares $dV_c/dt$ and zero voltage to generate the pulse $V_{comp}$, which is also outside $V_{center}$. The output of the AND gate, $V_{out}$, is always low and open lamp protection process is not triggered. FIG. 9 shows the waveforms of $dV_c/dt$, $V_{comp}$, $V_{center}$, and $V_{out}$ in the circuit of FIG. 7 under open lamp condition. When an open lamp condition occurs, $dV_c/dt$ changes its sign within $V_{center}$ and $V_{comp}$ overlaps with $V_{center}$. A pulse is generated in every cycle to trigger the open lamp protection process.

Figure 10:
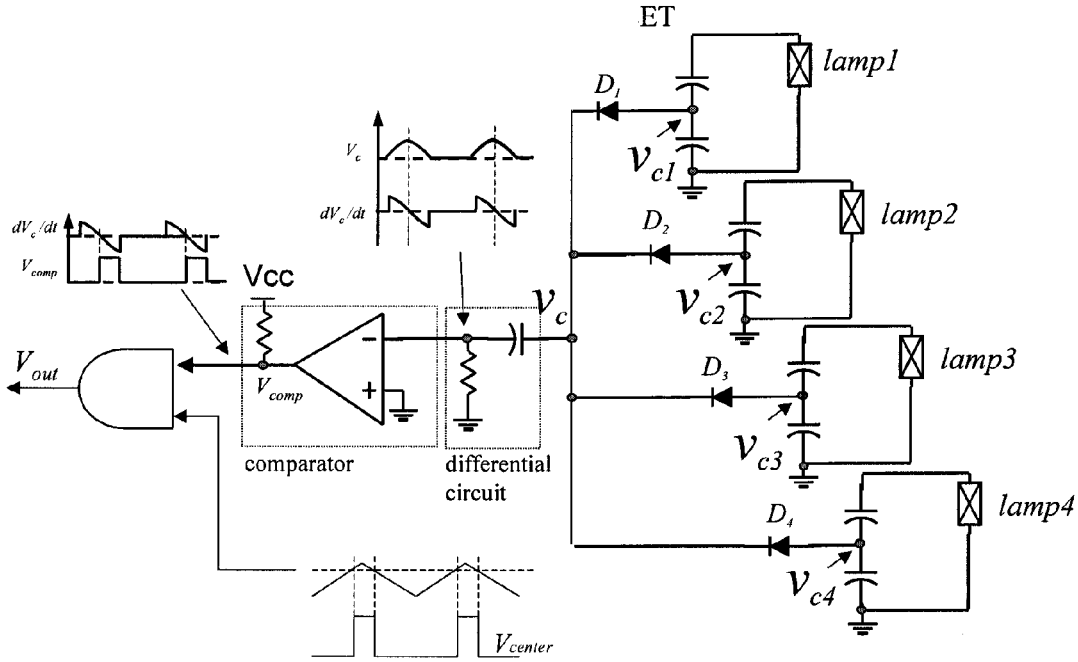
FIG. 10 An open lamp protection circuit in 4-lamp in-phase application.
Figure 11:
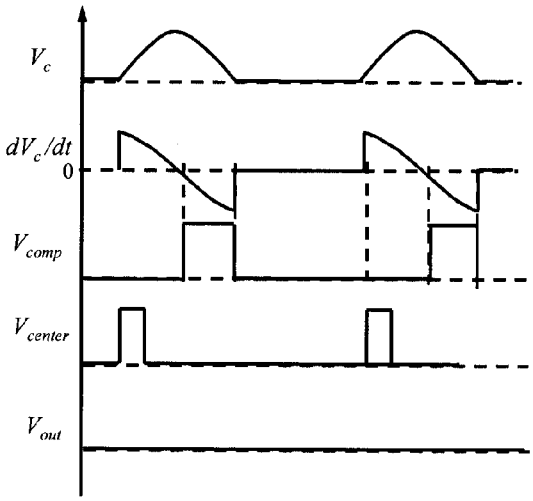
FIG. 11 Waveforms of $V_c$, $dV_c/dt$, $V_{comp}$, $V_{center}$, and $V_{out}$ in the circuit of FIG. 10 under normal operation condition.
Figure 12:
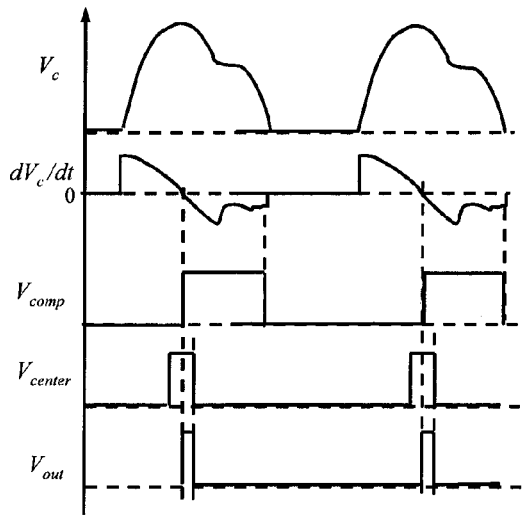
FIG. 12 Waveforms of $V_c$, $dV_c/dt$, $V_{comp}$, $V_{center}$, and $V_{out}$ in the circuit of FIG. 10 under open lamp condition.

Another embodiment of this invention is shown in FIG. 10 for multiple lamp applications. For simplicity of discussion, a 4-lamp in-phase application is discussed. Each sensed lamp voltage, $V_{c1}$ to $V_{c4}$, is coupled to the input terminal of a differential circuit through its corresponding diode, D1 to D4. All diodes have an OR gate configuration so that the input signal $V_c$ for the differential circuit follows the largest Vci value, wherein i is between 1 and 4. Like in a single-lamp application, $V_c$ is coupled to a capacitor and a grounded resistor. The output of the differential circuit, $dV_c/dt$, is coupled to the negative terminal of a comparator while the positive terminal of the comparator is coupled to ground or a threshold voltage $V_{th}$. The output of the comparator, $V_{comp}$, is coupled to an input terminal of an AND gate and a voltage source $V_{cc}$ through a resistor. The other input terminal of the AND gate is couple to $V_{center}$, which is generated by a triangular waveform and a DC level. $V_{center}$ represents the middle portion of $V_{in}$. Since the triangular waveform is also used to generate the duty cycle of the discharge lamp inverter, the phase of the pulse is exactly the same as that of $V_{in}$. The DC level is used to adjust the width of $t_W$. FIG. 11 shows the waveforms of $dV_c/dt$, $V_{comp}$, $V_{center}$, and $V_{out}$ in the circuit of FIG. 10 under normal operation condition. Under normal operation condition, $dV_c/dt$ changes its sign outside $t_W$. The comparator compares $dV_c/dt$ and zero voltage to generate the pulse $V_{comp}$, which is also outside $V_{center}$. The output of the AND gate, $V_{out}$, is always low and open lamp protection process is not triggered. FIG. 12 shows the waveforms of $dV_c/dt$, $V_{comp}$, $V_{center}$, and $V_{out}$ in the circuit of FIG. 10 under open lamp condition. When one or more lamps are open, there are two peaks in each waveform cycle of $V_c$. The higher peak is from the sensed voltage from opened lamps while the lower peak is from lamps under normal condition. The slew rate $dV_c/dt$ changes its sign within $V_{center}$ and $V_{comp}$ overlaps with $V_{center}$. A pulse is generated in every cycle to trigger the open lamp protection process.

In one embodiment of the present invention, a detection circuit is used to monitor the phase relationship between the lamp voltage $V_c$ and the excitation voltage $V_{in}$ in a single-lamp or multiple-lamp system, and trigger the open lamp protection process when one or more lamps are open. Under normal operation condition, the phase difference between $V_c$ and $V_{in}$ is large, typical more than 30 degrees; while under open lamp condition, the phase difference is close to zero degrees. In another embodiment of the present invention, the detection circuit calculates the slew rate of the sensed lamp voltage $dV_c/dt$ and compares it with a detection window $t_W$ which is located in the middle of $V_{in}$ pulse. If $dV_c/dt$ changes from positive to negative, or vice versa, within $t_W$, the open lamp protection process is triggered. If $dV_c/dt$ changes its sign, outside $t_W$, the open lamp protection process will not be triggered. One advantage of the present invention is that the lamp current detection circuit is not needed. The detection circuit can be incorporated into a lamp voltage feedback circuit to monitor and trigger the open lamp protection. Also, the detection circuit can be implemented on the integrated circuit level with less cost and circuitry complexity.

The description of the invention and its applications as set forth herein is illustrative open lamp voltage protection and is not intended to limit the scope of the invention. Variations and modifications of the embodiments disclosed herein are possible, and practical alternatives to and equivalents of the various elements of the embodiments are known to those of ordinary skill in the art. Other variations and modifications of the embodiments disclosed herein may be made without departing from the scope and spirit of the invention.

We claim:

1. A method for detecting an open lamp condition in a discharge lamp system, comprising:

monitoring a phase relationship between a lamp voltage and an excitation voltage through a detector circuit that is coupled to a discharge lamp or multiple discharge lamps;

deriving a voltage signal from said detector circuit;

if said voltage signal satisfies an open lamp condition, triggering an open lamp protection process, wherein said open lamp protection process is triggered when said phase relationship is approximately to zero degrees.

2. The method in claim 1, further comprising:

deriving a slew rate of said lamp voltage;

deriving a detection window located in the middle of a pulse of said excitation voltage;

comparing said slew rate with said detection window;

if said slew rate changes its signal within said detection window, triggering said open lamp protection process.

3. A method for detecting an open lamp condition in a discharge lamp, comprising:

monitoring a lamp voltage and an excitation voltage of the discharge lamp;

deriving a phase relationship between the monitored lamp voltage and the excitation voltage; and if the phase relationship indicates that the lamp voltage and the excitation voltage are generally in phase, triggering an open lamp protection process for the discharge lamp.

4. The method in claim 3, wherein deriving a phase relationship includes:

deriving a slew rate of the lamp voltage;

deriving a detection window located in a central portion of individual pulses of the excitation voltage; and if the slew rate changes from positive to negative or from negative to positive within the detection window, triggering the open lamp protection process.

5. The method in claim 3, wherein triggering an open lamp protection process includes removing the excitation voltage if the phase relationship indicates that the lamp voltage and the excitation voltage are generally in phase for a predetermined period of time.

6. A method for detecting an open lamp condition in a discharge lamp system, comprising:

monitoring a phase relationship between the lamp voltage and the excitation voltage through a detector circuit that is coupled to a discharge lamp or multiple discharge lamps;

deriving a voltage signal from said detector circuit;

deriving a slew rate of said lamp voltage;

deriving a detection window located in the middle of a pulse of said excitation voltage;

comparing said slew rate with said detection window; and if said slew rate changes its signal within said detection window, triggering an open lamp protection process and/or if said voltage signal satisfies an open lamp condition, triggering an open lamp protection process when said phase relationship is approximately to zero degrees;

wherein said detector circuit comprises:

a plurality of sensing capacitors being coupled to a first plurality of discharge lamps wherein one sensing capacitor corresponds to one discharge lamp and voltages of said first plurality of sensing capacitors are in phase;

a plurality of diodes being coupled to said plurality of sensing capacitors wherein one diode corresponds to one sensing capacitor;

a differential circuit with an input terminal being coupled to said plurality of diodes;

a comparator with a negative terminal being coupled to the output terminal of said differential circuit and a positive terminal being coupled to ground or a threshold voltage; and an AND gate with one input terminal being coupled to the output terminal of said comparator and the other input terminal being coupled to a pulse signal representing the middle portion of the excitation voltage.

7. The method in claim 6, wherein said first differential circuit comprises:

a capacitor being coupled to said plurality of diodes; and a grounded resistor being coupled to said capacitor and the negative terminal of said comparator.

8. The method in claim 6, wherein said pulse signal is generated by a DC level and a triangular waveform that is also used to generate the duty cycle of said discharge lamp system.

9. A circuit capable of detecting an open lamp condition, and triggering an open lamp protection process in a discharge lamp system, comprising:

a plurality of sensing capacitors being coupled to a plurality of discharge lamps wherein one sensing capacitor corresponds to one discharge lamp and the voltages of said plurality of sensing capacitors are in phase;

a plurality of diodes being coupled to said plurality of sensing capacitors wherein one diode corresponds to one sensing capacitor;

a differential circuit with its input terminal being coupled to said plurality of diodes;

a comparator with its negative terminal being coupled to the output terminal of said differential circuit and its positive terminal being coupled to ground or a threshold voltage; and an AND gate with one input terminal being coupled to the output terminal of said comparator and the other input terminal being coupled to a pulse signal representing the middle portion of the excitation voltage.

10. The circuit in claim 9, wherein said circuit is on an integrated circuit level.

11. The method in claim 9, wherein said differential circuit comprises:

a capacitor being coupled to said plurality of diodes; and a grounded resistor being coupled to said capacitor and the negative terminal of said comparator.

12. The circuit in claim 9, wherein said pulse signal is generated by a DC level and a triangular waveform that is also used to generate the duty cycle of said discharge lamp system.

* * * * *